US005623847A

United States Patent [19]

Uchiyama et al.

[11] Patent Number: 5,623,847

[45] Date of Patent: Apr. 29, 1997

[54] METHOD OF AND APPARATUS FOR DEEP DRAWING

[75] Inventors: Yoshihiro Uchiyama, Toyota; Kenji Tamada, Nagoya; Takashi Kosaka, Nisshin; Hiroshi Hiyama, Toyota, all of Japan

[73] Assignee: Toyota Jidosha Kabushiki Kaisha, Japan

[21] Appl. No.: 612,000

[22] Filed: Mar. 5, 1996

[30] Foreign Application Priority Data

Mar. 9, 1995 [JP] Japan ..... 7-049948

[51] Int. Cl.[6] ..... B21D 22/00; B21D 22/21

[52] U.S. Cl. ..... 72/348

[58] Field of Search ..... 72/348, 347, 350

[56] References Cited

U.S. PATENT DOCUMENTS 4,754,635 7/1988 Van Den Berg et al. ..... 72/347

FOREIGN PATENT DOCUMENTS 61-148423 9/1986 Japan .

4-167930A 6/1992 Japan ..... 72/347

OTHER PUBLICATIONS

"Development and Practical Use of New Method in Press Molding", Quality Control Journal, published May 1995 (6 pages).

"Integral Molding of Luggage Outer Panel and Housing", material delivered in a meeting of Technical Society for Molding of Thin Steel Plate held on Mar. 9, 1995 (10 pages).

*Primary Examiner*—Lowell A. Larson

*Assistant Examiner*—Rodney A. Butler

*Attorney, Agent, or Firm*—Finnegan, Henderson, Farabow, Garrett & Dunner, L.L.P.

[57] ABSTRACT

Deep drawing of a work can be made by securing a certain amount of feed of the work from the side of a cushion ring to a vertical wall surface of a stationary die. In this drawing method, for the drawing of the work, a die part interlocked to a movable die is engaged in a recess of the stationary die in a direction different from the direction of pushing. An edge of the work is displaced in unison with the cushion ring and the movable die clamping it in cooperation, and the die part starts to push the work immediately before the instant when the work located in the vicinity of the cushion ring is brought into contact with the edge of the recess of the stationary die. The resistance of contact between the work and the stationary die thus is not increased in the vicinity of the cushion ring when the die part pushes the work, and a certain amount of feed of the work from the side of the cushion ring can be secured.

3 Claims, 8 Drawing Sheets

METHOD OF AND APPARATUS FOR DEEP DRAWING

BACKGROUND OF THE INVENTION

1. Field of the Invention

This invention relates to a method of and an apparatus for permitting deep drawing of a work.

2. Description of the Prior Art

In a process of deep drawing of a work, it is liable that the work is excessively elongated to result in rupture. FIGS. 10(*a*) and 10(*b*) show an example of the deep drawing process. As shown, a panel W as a work is clamped between a stationary die 102 and a movable die 104, and it is elongated by lowering a punch 106 as shown by an arrow A. A portion of the work W which has a length lc before the process is elongated to a length lc1 after the process. With increasing drawing of the work, the elongation factor thereof is increased, making the work to be readily ruptured.

A technique which permits deep drawing of a work by preventing the rupture thereof, is disclosed in Japanese Laid-Open Utility Model Publication No. 61-148423. This technique will now be described with reference to FIGS. 9(*a*) and 9(*b*). In this technique, a stationary die comprising an immovable part 102*b* and a movable part 102*a* are used. The movable part 102*a* is displaced to the right as shown by an arrow B in synchronism with the descent of a punch 106 as shown by an arrow A. In this case, a portion of the work which has a length of la before the process is elongated to a length of la1 after the process. As is obvious from FIGS. 9(*a*), 9(*b*), 10(*a*) and 10(*b*), when the lengths la1 and lc1 after the process are equal, the length la before the process in FIG. 9(*a*) can be set to be greater than the length lc before the process in FIG. 10(*a*). That is, with the FIGS. 9(*a*) and 9(*b*) techniques, the elongation factor of the work can be suppressed much more than in the FIGS. 10(*a*) and 10(*b*) technique.

FIG. 7 shows a technique which was developed from the FIG. 9 technique. This technique was studied by the inventors while the present invention was developed. In this technique, a stationary die 111 having a recess 111*j* formed in the top surface (i.e., processing surface) is used. A movable die 115 is caused to approach the stationary die 111 as shown by a vector P. A movable die part 116 is caused to slide along a slanted surface 115*a* of the movable die 115 as shown by a vector S. While the movable die 115 approaches the stationary die 111 to an extent as shown by the vector P, the movable die part 116 is caused to slide slantedly along the movable die 115 to an extent as shown by the vector S. Reference numeral 112 designates a cushion ring which is biased upward by a pin 113. In FIG. 7, the cushion ring 112 is shown located at an intermediate level. The movable die 115 has a wrinkle restraining part 115*x*.

In this apparatus, as the movable die 115 approaches the stationary die 111, the work panel W is clamped between the cushion ring 112 and the wrinkle restraining part 115*x* of the movable die 115. Subsequently, a point A of the movable die part 116 is brought into contact with the work panel W, and eventually, the point A is displaced to a point B as shown by a vector K, thus completing the deep drawing process. The vector K is the vector sum of the vectors P and S. The vectors P and K have different directions.

FIG. 8 shows vector sums K1 to K3 when extent P to which the movable die 115 approaches the stationary die 111 while the movable die part 116 slides by the vector S, is set to P1 to P3, respectively. It will be seen that the greater the extent P the nearer the vertical the vector K is. Shown at A1 to A3 are the positions of contact between the movable die part 16 and the work panel W in the cases when the movable die part 116 is displaced by the vectors K1 to K3, respectively. Shown at C is the upper edge in the deep drawing process, i.e., the edge of the recess 111*j* on the side of the movable die 115. Obviously, the nearer the vertical the vector K is, the smaller the length before the process, and the nearer the horizontal the vector K is, the greater the length before the process.

As shown, in order to increase the length before the process and thus reduce the elongation factor, the vector K is suitably nearer the horizontal. To this end, the movable die part 116 suitably undergoes a displacement as shown by the vector S with a very small stroke right above the lower dead center of the movable die 115. In other words, the movable die part 116 suitably starts to be displaced when the movable die 115 is brought to a position D3 as shown in FIG. 8 rather than when the movable die 115 is brought to a position D1.

SUMMARY OF THE INVENTION

With a recognition that it is suitable to lower the position D of start of displacement of the movable die part 116 in order to obtain deep drawing with suppressed elongation factor of the work, the inventors conducted extensive experiments on the basis of the above analysis, and found that a factor which arises in the actual phenomenon was missed in the analysis.

The factor is that although the lowering of the position of the start of displacement of the movable die part 116 permits increasing the length of the work before the process, at the instant of start of the deep drawing process, as shown in FIG. 7, the work W is held strongly pressed by the edge F of the recess 111*j* on the side of the cushion ring 112, so that slide-in of the work W as shown by an arrow E which is expected during the deep drawing process is strongly prevented. Although it is necessary to secure a large length of the work before the process for suppressing the elongation factor of the work W, attaching too much importance to this results in suppression of the extent of the slide-in. The result is that the elongation factor can not be substantially satisfactorily suppressed.

An object of the invention is to permit further suppression of the elongation factor of the work compared to the prior art by sufficiently securing both the length of the work before the process and the slide-in extent.

Another object of the invention is to permit deep drawing which could have not been obtained in the prior art due to rupture of the work.

According to the invention, the position D of start of displacement of the movable die is lowered in a range in which the slide-in extent is not substantially strongly suppressed. More specifically, the deep drawing is started in a state that although the work W is clamped between the cushion ring 112 and the wrinkle restraining part 115*x* of the movable die 115 to prevent generation of wrinkles of the work W being drawn, no further restriction of the slide-in of the work is made so that the work can smoothly slide in with the progress of the deep drawing. The displacement of the movable die part is caused in as late timing as possible in the above state.

According to another aspect of the invention, a fact is noted that the work W is brought into contact with the edge F of the recess 111*j* on the side of the cushion ring 112 at an instant in the displacement stroke of the cushion ring 112 being displaced with the approach of the movable die 115, and that satisfactory slide-in can be obtained before that instant but can be obtained after that instant. From the consideration of this fact, the deep drawing is started right before the instant when the work W is brought into contact with the edge F. When this is done so, the work W is brought into contact with the edge F at an instant when the work W starts to undergo displacement with the start of the deep drawing, and the slide-in of the work W is continued after the instant when the work W is brought into contact with the edge F.

In the above way, according to the invention, it is possible to secure a large length of the work before the process while securing necessary slide-in of the work so that it is possible to hold the elongation factor of the work low. It is thus possible to obtain deep drawing which has been difficult in the prior art.

BRIEF DESCRIPTION OF THE DRAWINGS

The above and other objects, features and advantages of the invention will become more apparent from the detailed description of the preferred embodiment of the invention when the same is read with reference to the accompanying drawings, in which.

DETAILED DESCRIPTION OF THE PREFERRED EMBODIMENT

Figure 4A:
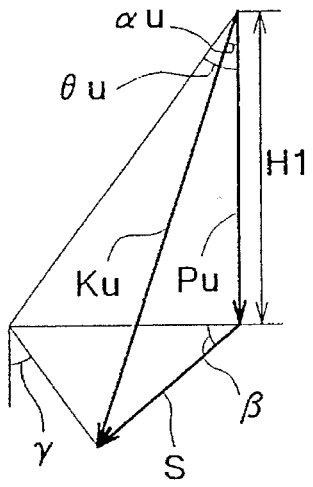
FIGS. 4(*a*) to 4(*c*) are vector diagrams showing vectors of displacement of the movable die part.
Figure 4B:
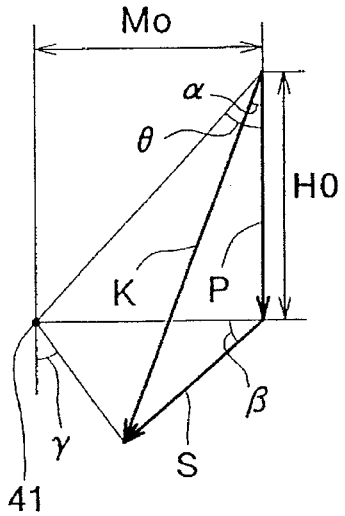
Figure 4C:
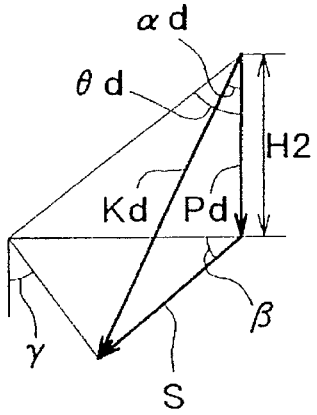
Figure 5:
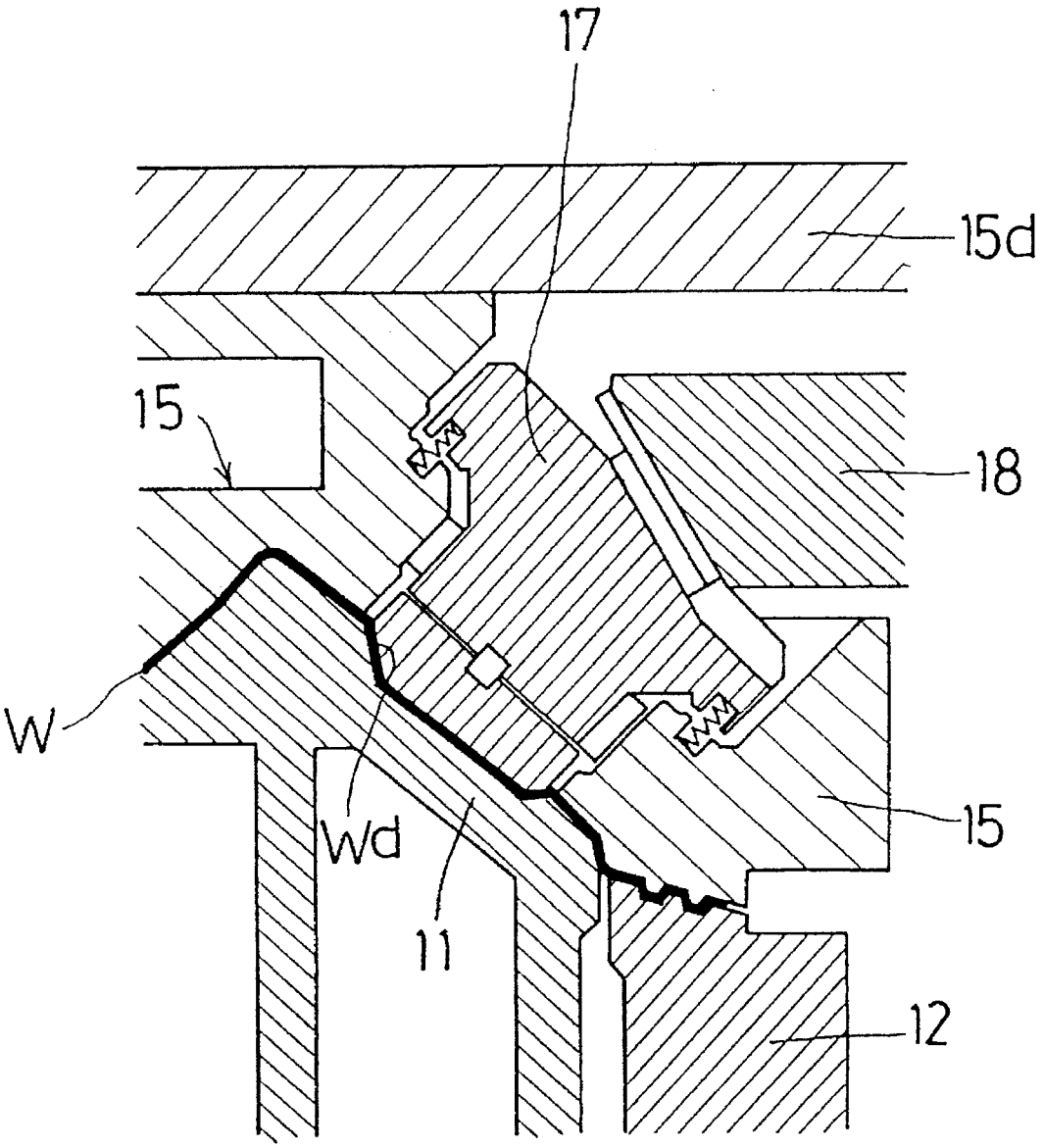
FIG. 5 is a view showing details of a portion of FIG. 6.
Figure 6:
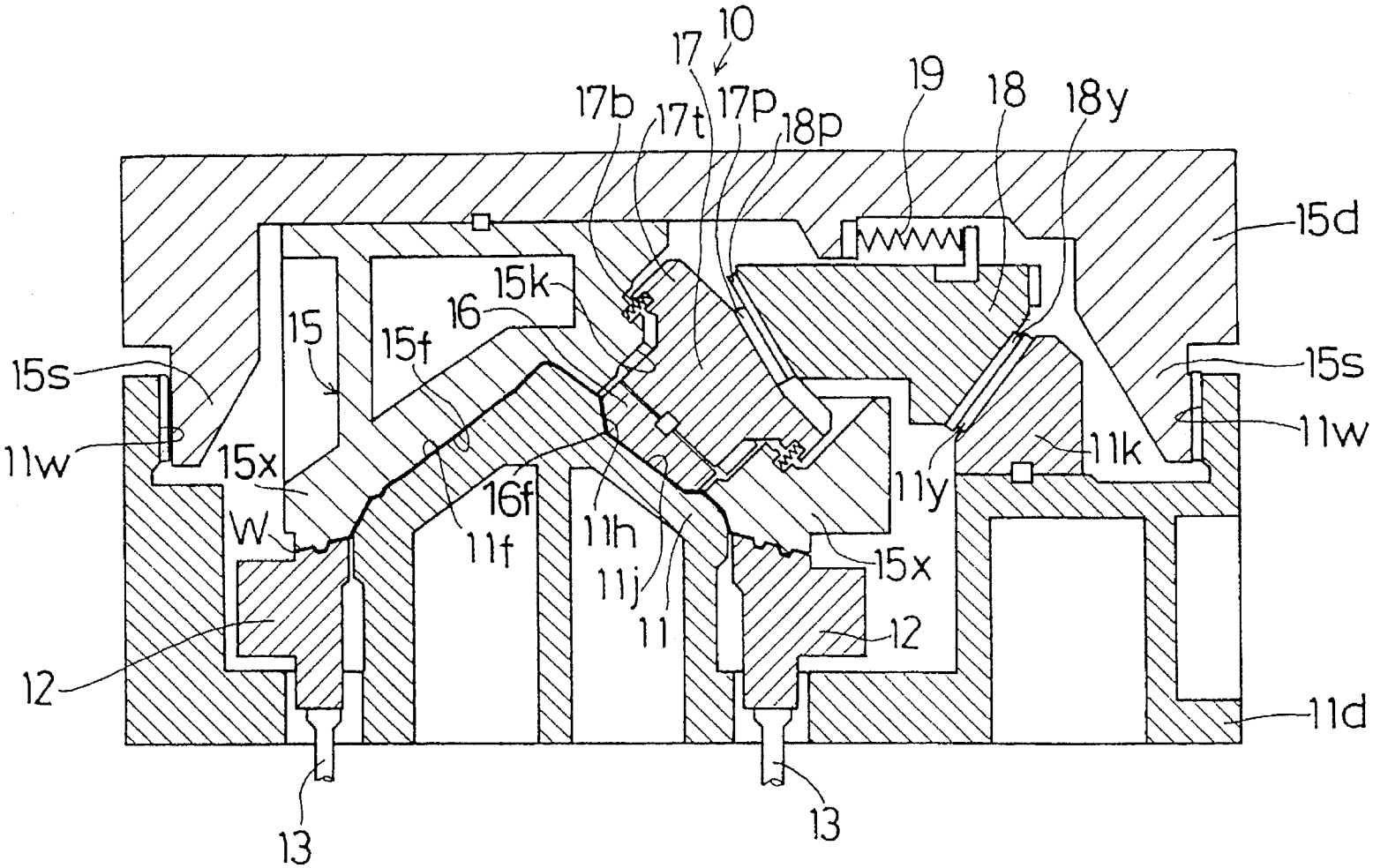
FIG. 6 is a sectional view showing a press for carrying out the deep drawing process in the embodiment of the invention.

An apparatus for and a method of deep drawing embodying the invention will now be described with reference to FIGS. 1 to 6. FIG. 6 is a side view showing a press 10 for carrying out a deep drawing process in an embodiment of the invention, and FIG. 5 is a view showing details of a portion of FIG. 6.

The illustrated press 10 is for carrying out cushion drawing. It comprises a stationary die 11 around which a cushion ring 12 for restraining wrinkles of work W is supported by a plurality of cushion pins 13 such that it can be raised and lowered. The cushion ring 12 is biased upward. The stationary die 11 has its lower portion secured to a lower base 11*d*, and it has a stationary cam 11*k* positioned on the lower base 11*d* at a prescribed position thereof (on the right side of the stationary die 11 in FIG. 6). The lower base 11*d* has a vertical side wall 11*w* formed along its edge. An upper base 15*d* has a slide part 15*s* slidable vertically along the inner surface of the side wall 11*w* of the lower base 11*d*. The upper base 15*d* can be displaced vertically in a state that its horizontal displacement relative to the lower base 11*d* is restricted.

The upper base 15*d* can be displaced vertically by a lift mechanism (not shown) in a predetermined range. The movable die 15 has a wrinkle restraining part 15*x* formed along the edge of its process surface 15*f*. During the descent of the movable die 15, the wrinkle restraining part 15*x* thereof grasps the edge of the work W. The movable die 15 has an open space 15*k* formed such as to be at a predetermined angle to the horizontal direction. A movable die part 16 and a second slide cam 17 supporting the movable die part 16 are accommodated in the open space 15*k* for sliding in the direction of the open space 15*k* (i.e., at an angle to the horizontal direction in FIG. 3). The movable die part 16 has a process surface 16*f* which is engaged as will be described hereinafter in a recess 11*j* of the stationary die 11 having a vertical wall surface 11*h* in a state that the process surface 16*f* of the movable die part 16 projects from the open space 15*k* to a prescribed extent as a result of the descent of the movable die 15 to the lower dead center.

The second slide cam 17 has a flange part 17*t* formed on the side opposite the movable die part 16. The flange part 17*t* is coupled via a second spring 17*b* to the outer surface of the movable die 15. A second slide plate 17*p* is secured to the back side of the flange part 17*t* of the second slide cam 17, and a first slide plate 18*p* provided on a first slide cam 18 is in plane contact with the second slide plate 17*p*.

The first slide cam 18 is mounted on the upper base 15*d* such that its horizontal displacement is allowed. A lower slide plate 18*y* is secured to the first slide cam 18 on the side thereof opposite the first slide plate 18*p*. During the descent of the upper base 15*d*, the lower slide plate 18*y* of the first slide cam 18 is brought into plane contact with an upper slide plate 11*y* of the stationary cam 11*k* provided on the lower base 11*d*. A first spring 19 is provided between the first slide cam 18 and the upper base 15*d* to bias the first slide cam 18 away from the second slide cam 17.

In the construction as described, with the descent of the upper base 15*d*, the lower slide plate 18*y* of the first slide cam 18 is lowered by following the upper slide plate 11*y* of the stationary cam 11*k*. The descent of the first slide cam 18 causes horizontal displacement of the first slide cam 18 to push the second slide cam 17, causing the second slide plate 17*p* of the second slide cam 17 to be lowered by following the first slide plate 18*p* of the first slide cam 18. With the descent of the first slide plate 18*p*, the second slide cam 17 is inserted into the depth of the open space 15*k* of the movable die 15 against the spring force of the second spring 17*b*. The insertion of the second slide cam 17 causes the movable die part 16 having been positioned at the end of the second slide cam 17 to project to a predetermined extent from the open space 15*k* toward the stationary die 11.

When the movable die 15 is raised and separated from the stationary die 11, the first and the second slide cams 17 and 18 are returned to their initial positions by the spring forces of the first and the second springs 19 and 17*b*.

Figure 3:
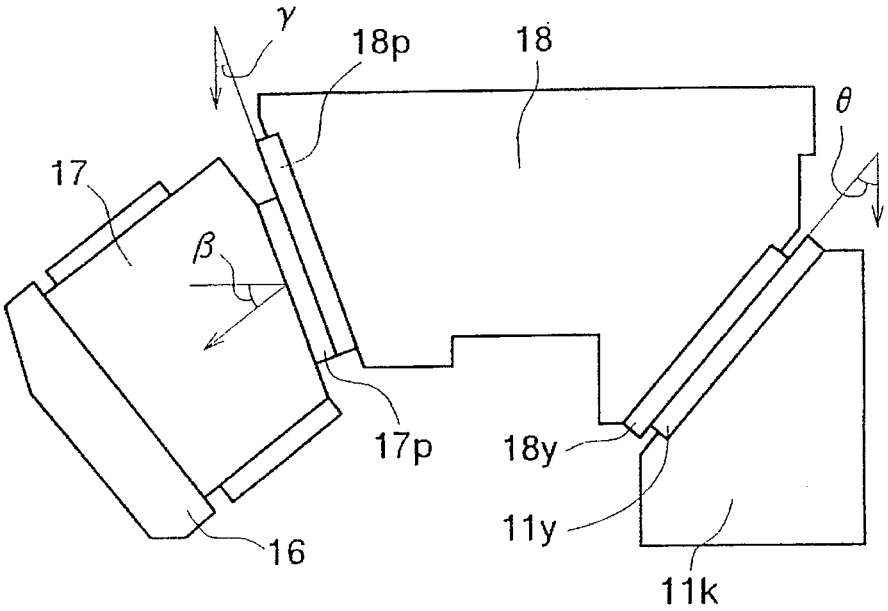
FIG. 3 is a side view showing the disposition relation of a first slide cam, a second slide cam, a movable die part, and a stationary cam provided on a lower base in the embodiment to one another.

FIG. 3 is a side view showing the disposition relation of the first and the second slide cams 18 and 17 and the movable die part 16 provided on the upper base 15*d* and the stationary cam 11*k* provided on the lower base 11*d*. FIG. 4(*b*) is a vector diagram showing the vector of displacement of the movable die part 16 under the conditions shown in FIG. 3.

As shown in FIG. 3, the upper slide plate 11*y* of the stationary cam 11*k* and the lower slide plate 18*y* of the first slide cam 18 are set to an inclination angle θ with respect to the direction of pressing in a manner to be described later. Also, the first slide plate 18*p* of the first slide cam 18 and the second slide plate 17*p* of the second slide cam 17 are set to an inclination angle γ with respect to the direction of the pressing. The direction of displacement of the second slide cam 17 is set to an angle β with respect to the horizontal direction as described above. Thus, when the extent of descent of the upper base 15*d* from a state of plane contact of the lower slide plate 18*y* of the first slide cam 18 with the upper slide plate 11*y* of the stationary cam 11*k* as shown in FIG. 3 obtained with the descent of the upper base 15*d*, i.e., from the instant of the start of operation of the cams 11*k*, 18 and 17, down to the lower dead center of the upper base 15*d* is set to HO, the descent of the upper base 15*d* by a distance of HO causes a displacement of the first slide cam 18 in the horizontal direction by a distance of MO (=HO.tan θ) relative to the upper base 15*d*.

The horizontal displacement of the first slide cam 18 by the distance of MO causes the second slide cam 17 to be pushed by the first slide cam 18 in the horizontal direction to be displaced at an angle β to the horizontal relative to the upper base 15*d* by the action of the first and the second slide plates 18*p* and 17*p*. The displacement of the second slide cam 17 is represented by the vector S in FIG. 4(*b*). The length of the vector S is determined by its intersection point with a line extending from point 41 at an angle γ. The movable die part 16 is moved in unison with the second slide cam 17, and thus, the vector S also represents the displacement of the movable die part 16 relative to the upper base 15*d*. Thus, vector K which represents the displacement of the movable die part 16 relative to the stationary die 11, i.e., the direction in which the movable die part 16 pushes the work W, is given as the vector sum of the vector P representing the extent of descent of the movable die 16 (i.e., extent of descent of the upper base 15*d*) and the vector S representing the displacement of the movable die 16 relative to the upper base 15*d*. The direction of displacement of the movable die part 16 relative to the upper base 15*d* (i.e., direction of the vector S) is determined by the overall construction of the press and can not be changed as desired. Therefore, the angles β and γ are fixed.

FIG. 4(*a*) is a vector diagram showing a vector representing the displacement of the movable die part 16 in case of setting a large extent of the descent of the upper base 15*d* from the instant of start of operation of the cams 11*k*, 18 and 17 down to the lower dead center without changing the direction and extent of displacement of the movable die part 16 relative to the upper base 15*d* (i.e., vector S).

In order to increase the descent extent H1 (H1>HO) of the upper base 15*d* in the fixed state of the vector S, the angle θ has to be reduced since the angles β and γ in FIG. 3 are fixed. Consequently, the angle αu of the vector Ku of pushing of the movable die part 16 to the direction of pressing (i.e., vector Pu) is made smaller than the angle α of the vector K of pushing when the descent extent is HO, as shown in FIGS. 4(*a*) and 4(*b*). Obviously, the prior-to-process length of the portion of the work that is drawn by the movable die part 16 is reduced by increasing the descent extent H1.

FIG. 4(*c*) is a vector diagram showing a vector representing the displacement of the movable die part 16 in case of setting a small extent of the descent of the upper base 15*d* from the instant of start of operation of the cams 11*k*, 18 and 17 down to the lower dead center without changing the direction and extent of displacement of the movable die part 16 relative to the upper base 15*d*.

In order to reduce the descent extent H2 (H2<HO) of the upper base 15*d* in the fixed state of the vector S, the angle θ has to be increased since the angles β and γ in FIG. 3 are fixed. Consequently, the angle αd of the vector Kd of pushing of the movable die part 16 to the direction of pressing (i.e., vector Pd) is made larger than the angle α of the vector K of pushing when the descent extent is HO as shown in FIGS. 4(*b*) and 4(*c*). Obviously, the prior-to-process length of the portion of the work that is drawn by the movable die part 16 is increased by reducing the descent extent H2.

Figure 7:
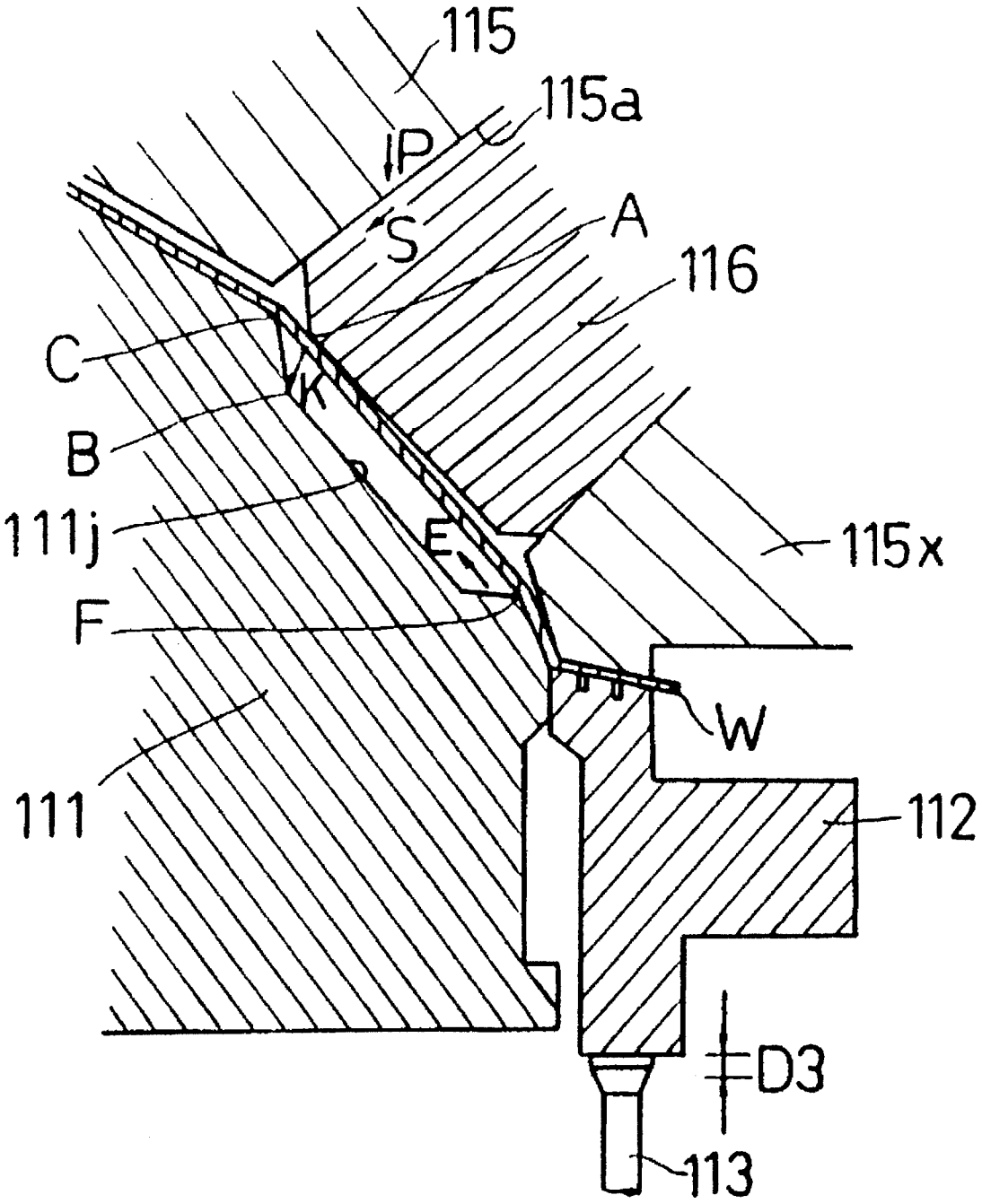
FIG.7 PRIOR ART
FIG. 7 is a side view showing a prior art elongation process.
Figure 8:
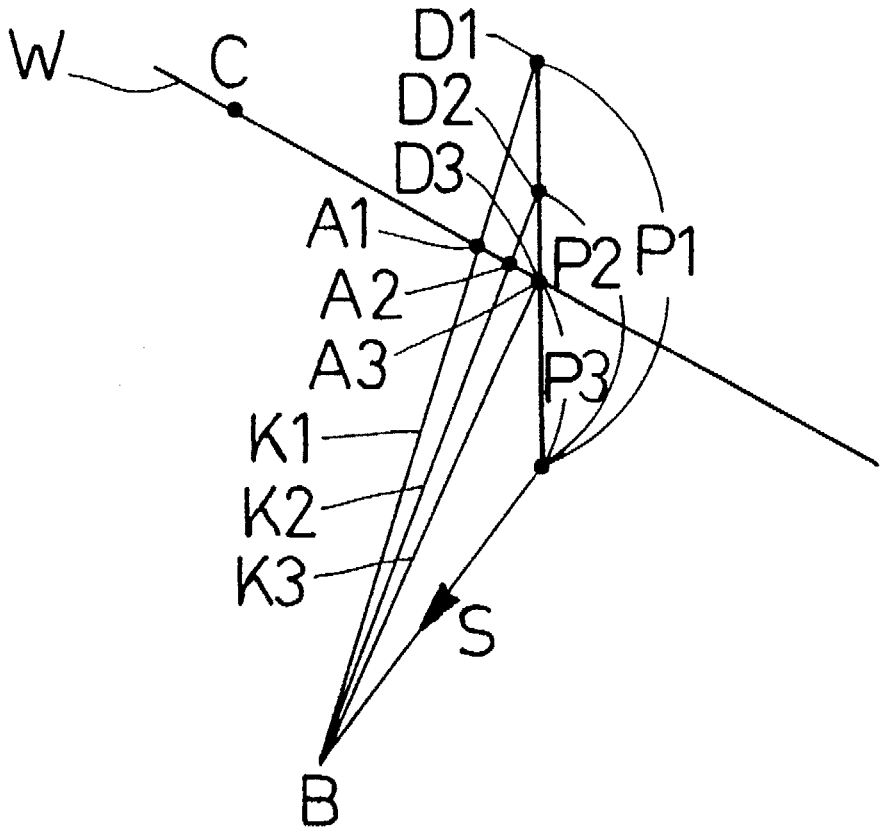
FIG. 8 is a vector diagram showing vectors of displacement of a movable die part in the prior art process.
Figure 9A:
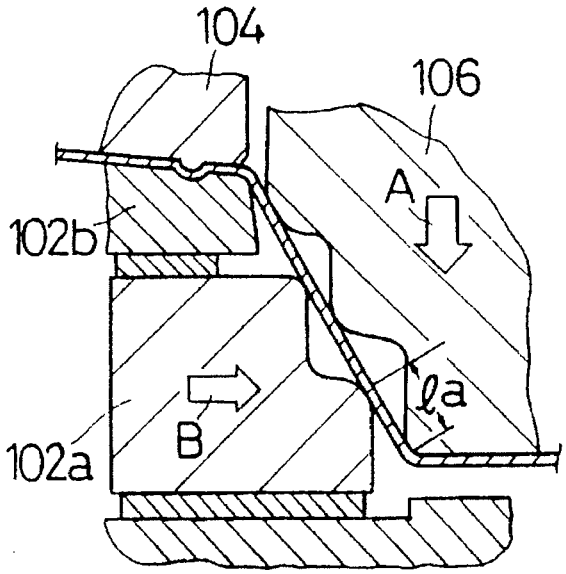
FIG.9(a) PRIOR ART
FIGS. 9(*a*) and 9(*b*) are sectional views showing a different prior art elongation process.
Figure 9B:
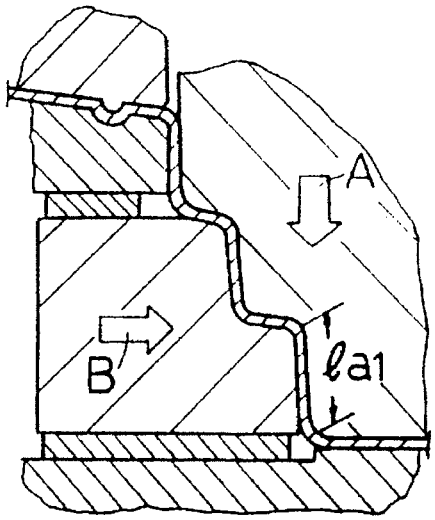
FIG.9(b) PRIOR ART
Figure 10A:
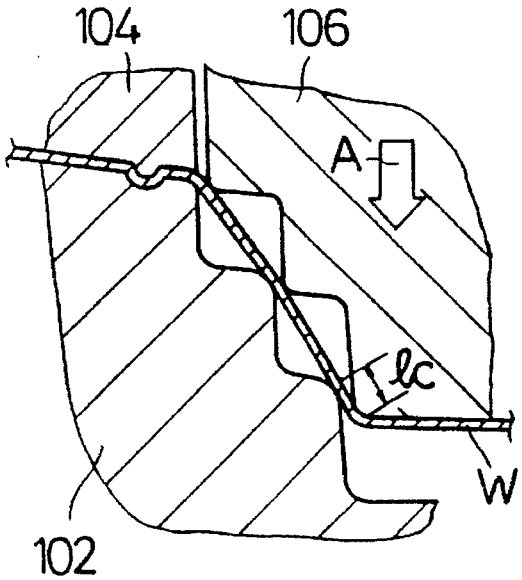
FIG.10(a) PRIOR ART
FIGS. 10(*a*) and 10(*b*) are side views showing a further prior art elongation process.
Figure 10B:
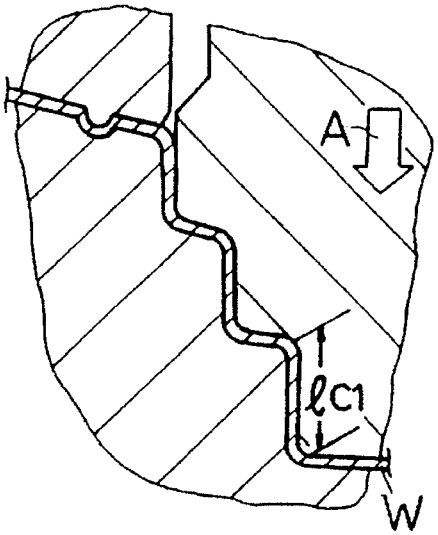
FIG.10(b) PRIOR ART

However, as described earlier in construction with FIG. 7, by causing the pushing of the work W by the movable die part 16 to be started in a stage with the upper base 15*d* lowered to the vicinity of the lower dead center in order to increase the prior-to-process length L1 of the work, the drawing is started with the work W held strongly restrained by the edge F with the result that the extent of slide-in (or feed) of the work W from the side of the cushion ring 12 is reduced. This phenomenon is pronounced when the rate of drawing by the movable die part 16 is high or when the coefficient of friction of the work W is high. This means that for deep drawing, it is necessary to provide an adequate balance in setting the prior-to-process length of the work and the amount of slide-in or feed of the work.

Figure 1:
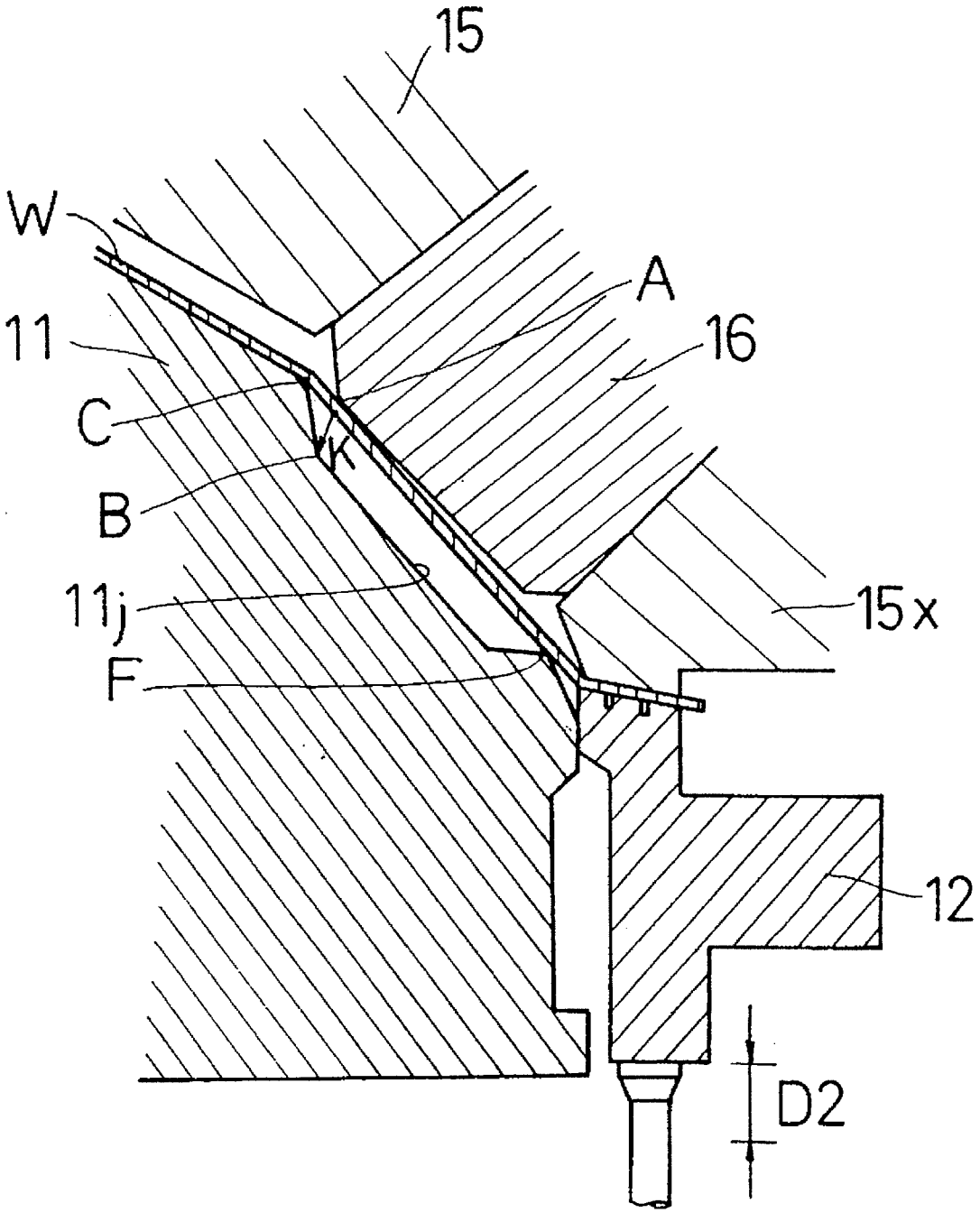
FIG. 1 is a side view showing a deep drawing process in an embodiment of the invention.

In this embodiment, the movable die part 16 is adapted to start pushing of the work W immediately before the instant when the work W is brought into contact with the edge F of the recess 11*j* of the stationary die 11 on the cushion ring side, i.e., the edge F in the direction shown by the vector K, that is, immediately before the instant when the upper base 15*d* or the like is at a position of height D2 as shown in FIG. 1 from the lower dead center. The drawing is started by the opposite side edge C and the movable die part 16.

Figure 2:
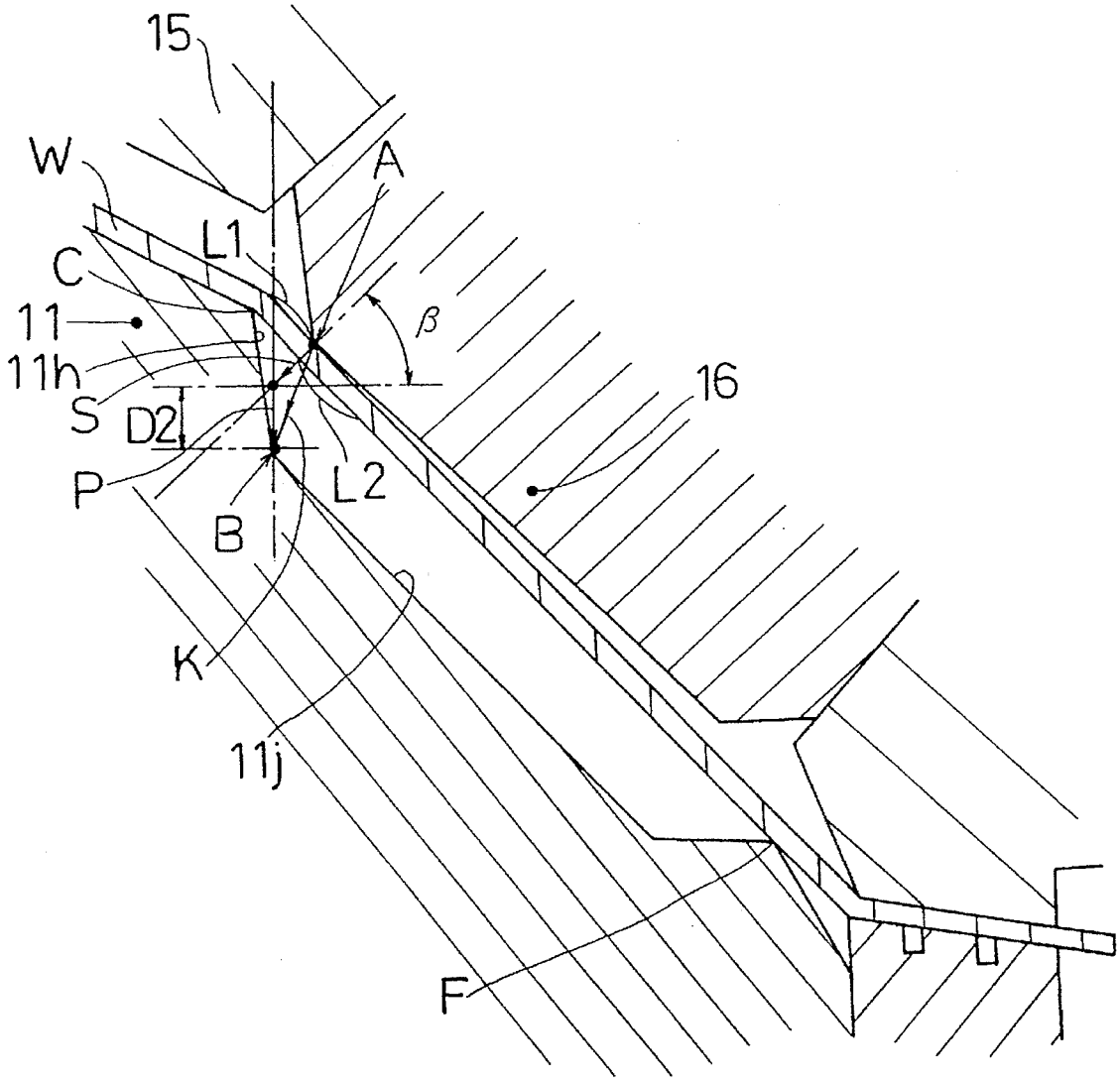
FIG. 2 is a view showing details of a portion of FIG. 1.

As shown in FIG. 2, the direction and distance of actual pushing of the work W by the movable die part 16 are represented by a vector AB, where A is a point at which the movable die part 16 is brought into contact with the work W and B is a point at which the edge of the movable die part 16 at the point A has to be located at the end of the drawing process. Thus, the angle θ, i.e., the angle of the upper slide plate 11*y* of the stationary cam 11*k* and the lower slide plate 18*y* of the first slide cam 18, can be determined by substituting the vector AB for the pushing vector K in FIG. 4(*b*), substituting the distance D2 for the descent extent HO and drawing a diagram with the angles β and γ to fixed angles.

In other words, in the press 10 of this embodiment, the angle θ of the upper slide plate 11*k* of the stationary cam 11*k* and the lower slide plate 18*y* of the first slide cam 18 is set such that the movable die part 16 is able to push the work W adequately immediately before the instant when the work W is brought into contact with the edge F of the stationary die 11, i.e., from the instant when the upper base 15*d* or the like is set at a position of height D2 from the lower dead center.

The method of drawing of this embodiment will now be described while describing the operation of the press 10.

In the press 10, when the upper base 15*d* is lowered down to a predetermined position in a state that the work W is set in a prescribed position, the edge of the work W is clamped between and restrained by the wrinkle representing part 15*x* of the movable die 15 and the cushion ring 12. While the upper base 15*d* is lowered from this state down to the lower dead center, the cams 11*k*, 18 and 17 start operation and, as shown in FIG. 1, the movable die part 16 starts pushing the work W immediately before the instant when the work W located in the vicinity of the cushion ring 12 is brought into contact with the edge F of the recess 11*j* of the stationary die 11. As described before, the distance of the upper base 15*d* and the cushion ring 12 from the lower dead center at this moment, is set to D2. The distance D2 is greater than the distance D3 in FIG. 7.

While the upper base 15*d* and other parts are lowered from this instant down to the lower dead center, the movable die part 16 pushes the work W as it is displaced in the direction from the point A to the point B. As a result, a step Wd of the final product is formed as shown in FIG. 5.

As shown, in the method of drawing of this embodiment, the movable die part 16 is adapted to start pushing the work W immediately before the instant when the work W located in the vicinity of the cushion ring 12 is brought into contact with the edge F of the recess 11*j* of the stationary die 11. With this arrangement, the resistance of the contact between the movable die part 16 and the work W is not substantially increased in the vicinity of the cushion ring 12 when the movable die part 16 pushes the work W. It is thus possible to secure necessary amount of feed of the work W from the cushion ring side of the vertical wall surface 11*h* of the stationary die 11.

Moreover, the angle at which the movable die part 16 pushes the work W can be set according to the height D2 of the upper base 15*d* and other parts from the lower dead center at the instant when the work W is brought into contact with the edge F of the recess 11*j* of the stationary die 11. This permits setting of the prior-to-process length of the work to be as large as possible while the necessary amount of feed of the work is secured, thus permitting deep drawing to be obtained. Consequently, it is possible to reduce restrictions imposed on the shape of the product, and the scope of application of the drawing process can be increased.

While a preferred embodiment of the invention has been described in the foregoing, it is by no means limitative, and changes and modifications may be made in the details of design without departing from the scope and spirit of the invention.

What is claimed is:

1. A deep drawing apparatus comprising:

a stationary die having a recess formed in a process surface;

a movable die for approaching the stationary die along a vector P;

a movable die part having displacement relative to the movable die and undergoing a displacement along a vector K, the direction being different from that of the vector P, while the movable die approaches the stationary die, the movable die part being adapted to enter the recess for deep drawing a work when the movable die has approached the stationary die until the work is clamped between the movable die and the stationary die;

a cushion ring disposed adjacent to the stationary die for displacement a predetermined distance along the vector P, the cushion ring being adapted to clamp an edge of the work in cooperation with the movable die while the movable die approaches the stationary die, the clamped edge being displaced in the direction of the vector P with further approach to the stationary die by the movable die, the movable die part entering the recess before the edge of the work clamped between the cushion ring and the movable die is brought into contact with an edge of the recess.

2. The deep drawing apparatus according to claim 1, wherein the instant when the movable die part begins to enter the recess is set to be immediately before the instant when the work is brought into contact with the edge.

3. A method of drawing a work comprising:

displacing a movable die part along a resultant vector K relative to a stationary die prior to pushing the work into a recess of the stationary die;

initiating the drawing of the work by contacting the work with the movable die part at a side edge of the recess so that the movable die begins to push the work into the recess;

bringing the work into contact with an opposite side edge of the recess; and having the step of initiating the drawing of the work by contacting the work with the movable die part occurring immediately prior to the step of bringing the work into contact with the opposite side edge of the recess.

* * * * *